US005509217A

United States Patent [19]

Condini

[11] Patent Number: 5,509,217

[45] Date of Patent: Apr. 23, 1996

[54] INNER COMFORT BOOT FOR SKI BOOT

[75] Inventor: Alessandro Condini, Villazzano, Italy

[73] Assignee: Lange International S.A., Lausanne, Switzerland

[21] Appl. No.: 340,166

[22] Filed: Nov. 15, 1994

[30] Foreign Application Priority Data

Dec. 1, 1993 [CH] Switzerland ..... 3585/93

[51] Int. Cl.[6] ..... A43B 23/07

[52] U.S. Cl. ..... 36/10; 36/119; 36/71; 36/93; 36/55

[58] Field of Search ..... 36/10, 71, 55, 36/93, 88, 119, 93, 7.3, 97; 2/61

[56] References Cited

U.S. PATENT DOCUMENTS

| | | | |
|---|---|---|---|
| 1,543,353 | 6/1925 | Wolff | 2/61 |
| 3,419,974 | 1/1969 | Lange | 36/120 |
| 3,858,337 | 1/1975 | Vogel | 36/55 |
| 3,945,134 | 3/1976 | Ramer | 36/118 |
| 3,977,098 | 8/1976 | Chalmers | 36/71 X |
| 4,523,392 | 6/1985 | Gabrielli | 36/88 X |
| 5,174,050 | 12/1992 | Gabrielli | 36/54 X |

FOREIGN PATENT DOCUMENTS

| | | | |
|---|---|---|---|
| 2657502 | 8/1991 | France . | |
| 578325 | 8/1976 | Switzerland | 36/71 |
| 626793 | 12/1981 | Switzerland . | |

*Primary Examiner*—Paul T. Sewell
*Assistant Examiner*—Ted Kavanaugh
*Attorney, Agent, or Firm*—Kane, Dalsimer, Sullivan, Kurucz, Levy, Eisele and Richard

[57] ABSTRACT

The inner boot is equipped with an at least partially elastic outer casing (8), the inner face of which is intended to receive corrective pieces (23) for individual adaptation of the volume of the boot to the foot of the wearer. The elasticity of the casing is provided, for example, by two elastic bands (13, 14) and the casing preferably has cutouts and indentations (10, 11, 12) which facilitate the putting in place and the removal of the corrective pieces.

8 Claims, 2 Drawing Sheets

INNER COMFORT BOOT FOR SKI BOOT

FIELD OF THE INVENTION

The present invention relates to an inner comfort boot for a ski boot comprising means intended for retaining on the inner boot corrective pieces for the local modification of the thickness of the inner boot, so as to make possible an adaptation of the internal volume of the boot to the foot of the user to afford him optimum holding of the foot.

PRIOR ART

A ski boot must be sufficiently rigid to ensure good holding of the foot and good transmission of the forces from the leg to the ski so as to ensure perfect control of the ski, but this holding must be carried out while ensuring the comfort of the foot, this comfort being obtained by means of the inner comfort boot which is generally constituted by an envelope made of semi-rigid plastic, lined with a compressible material.

For this purpose, different means have been proposed, which make it possible for the retailer and/or the user to add to or remove from the inner boot corrective pieces which make it possible to modify the thickness of the inner boot.

From the Patent U.S. Pat. No. 3,977,098, an inner comfort boot is known, which comprises two lateral pockets, the opening of which is constituted by a median slot and into each of which the retailer or the user can slide plates of felt or other material of different thicknesses to augment locally the thickness of the inner boot so as to fill the spaces between the foot and the shell of the boot. This solution necessitates a special construction of the inner boot. Moreover, it is difficult to remove the corrective pieces to exchange them for other pieces, for example in a case where the user wishes to increase the tightening of the boot or when the boot changes user. Furthermore, the correction is always effected in the same place although the corrective pieces can be displaced accidentally in their housing.

From the Patent U.S. Pat. No. 4,523,392, an inner boot is also known, which is equipped with two lateral pockets which are open towards the rear for the introduction of a padding in one piece extending behind the shaft and on each side of the lining. An outer casing made of felt attached to the shaft of the inner boot in a permanent manner by its upper edge is turned down on each side of the inner boot, around the heel and under the foot, so as to come to cover the padding. This solution also necessitates a special construction of the inner boot and does not always make it possible to place the corrective pieces in the desired place.

From the Patent CH 626,793, an inner boot is moreover known, the outer structure of which is looped so as to make possible the fixation of yokes by a system of micro-loops of the "VELCRO"(registered trademark) type, either directly, or by covering by a retaining piece. This solution not only necessitates a looped surface but the corrective pieces can be torn off during removal of the inner comfort boot from the boot or during its introduction into the boot.

SUMMARY OF THE INVENTION

The aim of the present invention is to produce an inner comfort boot, the means of retaining the corrective pieces of which make it possible easily and securely to fix corrective pieces in the desired places, these retaining means having to be such that they can be adapted easily to current inner boots without appreciable modification of these inner boots.

The inner boot according to the invention is characterized in that said means of retaining the corrective pieces are constituted by an at least partially elastic outer casing which extends at least over the sides of the inner boot and is fixed to the inner boot in the region of its sole.

The casing is preferably indented and/or perforated so as to make possible good access to the space between the casing and the inner boot in order to introduce therein corrective pieces which will preferably be elements equipped with a self-adhesive surface. For this purpose, the casing is preferably made essentially of a non-elastic, for example woven, material, the inner surface of which is plasticized, the elasticity of the casing being provided by elastic bands extending over the foot and over the instep. The adhesion of the corrective pieces does not have to be strong given that the casing protects these pieces against any risk of tearing off during the introduction of the inner boot into the shell of the boot or its removal.

Since the heel and the toe in principle necessitate no correction, the casing does not extend around the heel or around the toe.

BRIEF DESCRIPTION OF THE DRAWINGS

The attached drawing represents, by way of example, an embodiment of the invention.

DESCRIPTION OF THE PREFERRED EMBODIMENT

Figure 1:
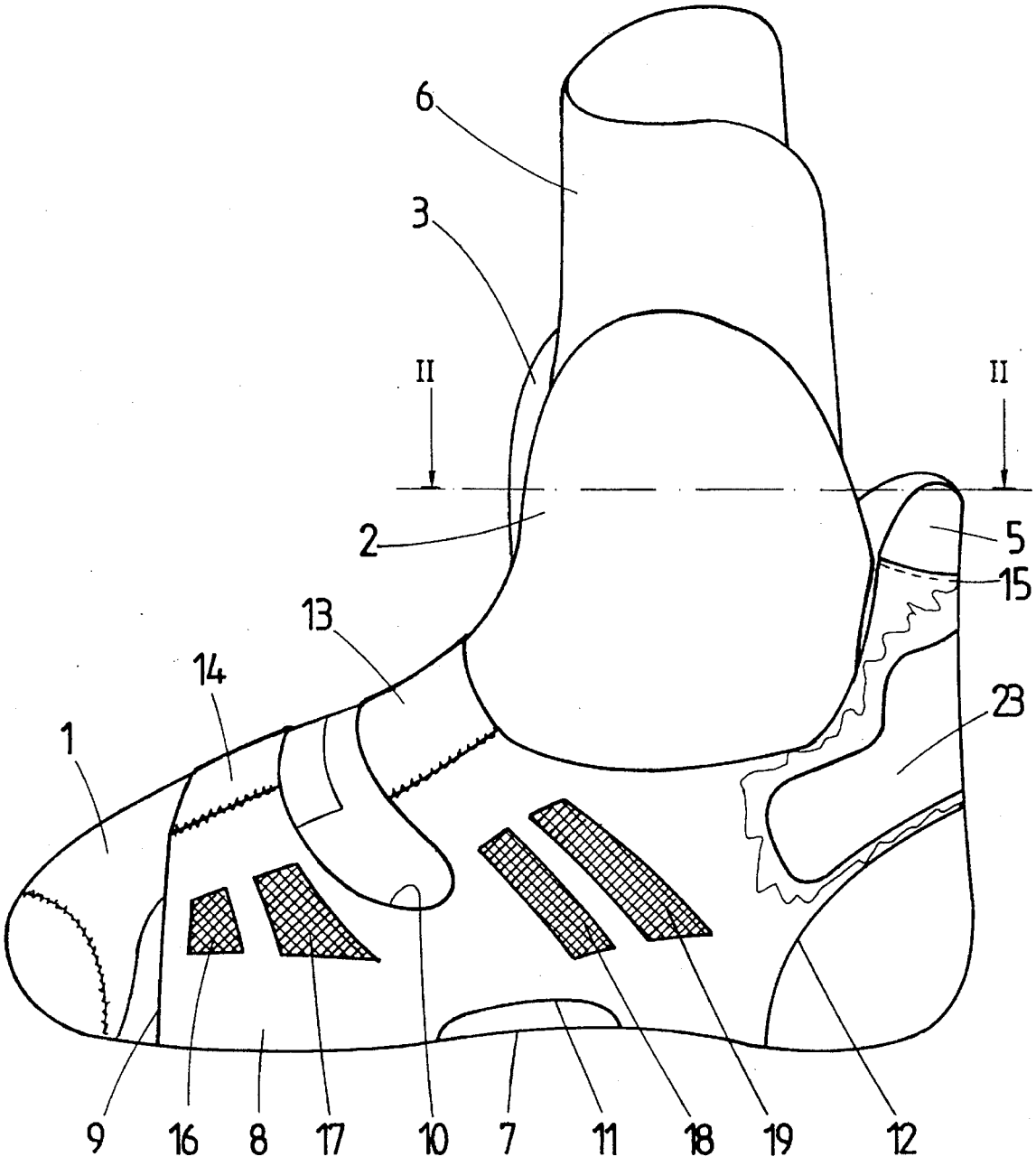
FIG. 1 is a lateral view of the inner boot, seen from the inner side of the foot.
Figure 2:
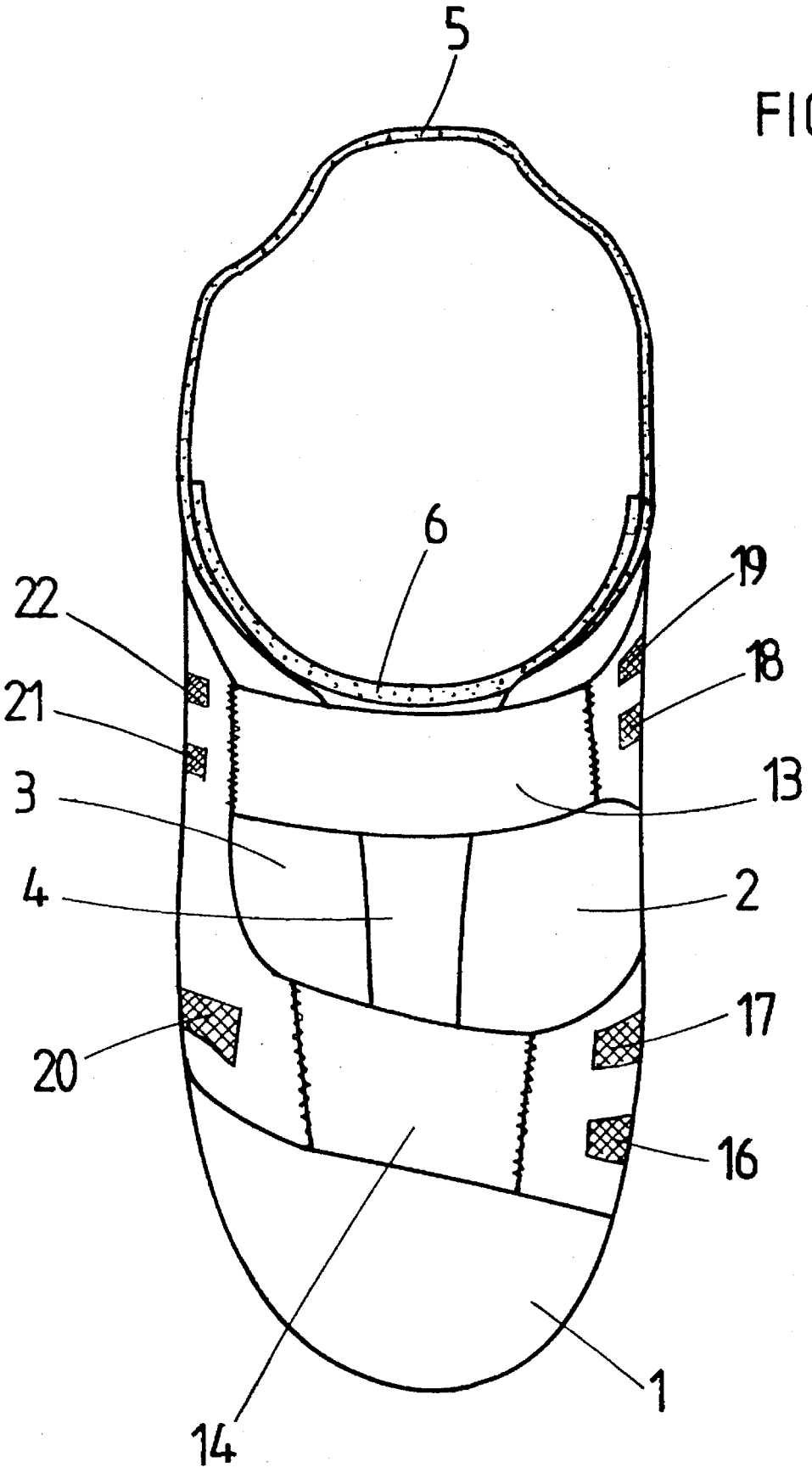
FIG. 2 is a view from above and in cross-section according to II—II in FIG. 1.

The inner boot 1 is constituted, in known manner, by a number of panels sewn together, each of these panels being constituted by a synthetic knitted fabric stuck on a panel made of synthetic, preferably cellular, material. The inner boot has two lateral ears 2 and 3 which rise on each side of the ankle and form between them a slot 4 extending over the instep.

At the rear of the inner boot, these two lateral parts 2 and 3 meet on the inner wall of a rear tongue 5. The inner boot is moreover equipped with a large tongue 6 intended to extend over the instep and the front of the leg.

The inner boot is equipped with a sole 7 made of profiled plastic material.

The inner boot is partially covered on the outside by a casing 8 made of woven synthetic material which is plasticized on its inner face. This casing 8 has cutouts 9, 10, 11 and 12. The cutout 9 frees completely the front of the inner boot while the cutout 12 exposes the heel. The cutout 10 extends transversely over the foot. The cutout 11 is formed in the median part of the lower edge of the casing, on the inner side of the foot. On the instep and on the front of the foot, the plasticized fabric of the casing 8 is interrupted and replaced by two woven elastic bands 13 and 14. The casing 8 is fixed to the inner boot, on the one hand by its lower sides via the sole 7 and on the other hand at the upper part of the rear tongue 5 by its upper edge via a seam 15. The casing therefore has the form of a sandal which is open at its ends. The fabric of the inner boot moreover has openings 16, 17, 18, 19, 20, 21, 22 laterally, which allow a mesh constituting the structure of the inner plasticized coating to appear.

The presence of the elastic bands 13 and 14 makes it possible to move the casing 8 away from the inner boot so as to make it possible to fix on the inner face of the casing 8 self-adhesive corrective pieces, such as the shaped piece 23 fixed so as to extend above the heel and on each side of the inner boot.

Corrective pieces of any shape and of any size can be fixed or removed at will at any point of the casing 8.

The corrective pieces can be made of incompressible material, such as felt, or of elastic material such as rubber or similar.

According to a variant of the embodiment described above, the casing 8 could be made of a single piece made of elastic material.

According to another variant, the casing 8 could be made in the form of a sort of elastic sock slipped onto the inner boot 1 and then fixed to the latter by the sole and at the rear, as in the exemplary embodiment described.

I claim:

1. An inner comfort boot for a ski boot comprising means intended for retaining on the inner boot corrective pieces (23) for modification of the thickness of the inner boot, wherein said means of retaining the corrective pieces are constituted by an at least partially elastic outer casing (8) which extends at least over the sides of the inner boot and is fixed to the inner boot in the region of its sole (7), the casing (8) being in the form of a sandal with cut out portions at its ends (9, 12) and transversely over the foot.

2. The inner boot as claimed in claim 1, wherein the casing is perforated.

3. The inner boot as claimed in claim 1, wherein the casing (8) is essentially made of non-elastic material forming two lateral parts which are joined together at the rear and connected on the foot by elastic bands (13, 14).

4. The inner boot as claimed in claim 3, wherein the non-elastic material is a woven material coated on the inside with plastic material.

5. The inner boot as claimed in claim 4, wherein the inner plastic coating of the casing comprises a mesh structure.

6. The inner boot as claimed in claim 1, wherein the casing (8) is moreover fixed at the rear of the inner boot (15) above the heel.

7. The inner boot as claimed in claim 1, wherein the corrective pieces (23) are fixed to the inner face of the outer casing (8).

8. The inner boot as claimed in claim 7, wherein the corrective pieces have a self-adhesive face for fixation by adhesion to the inner face of the outer casing.

* * * * *